United States Patent [19]

McCann

[11] Patent Number: 4,993,435

[45] Date of Patent: Feb. 19, 1991

[54] SMOKING ACCESSORY

[76] Inventor: Steven McCann, 543 E. 1800 N, N. Logan, Utah 84321

[21] Appl. No.: 465,339

[22] Filed: Jan. 16, 1990

[51] Int. Cl.[5] ..... A24F 13/02; A24F 13/08; A24F 13/22; A24F 19/00

[52] U.S. Cl. ..... 131/330; 131/175; 131/206; 131/212.1; 131/215.1; 131/215.2; 131/215.3; 131/202; 131/213; 131/231; 131/235.1; 131/238

[58] Field of Search ..... 131/330, 175, 206, 202, 131/212.1, 213, 215.1, 215.2, 215.3, 231, 235.1, 238, 329

[56] References Cited

U.S. PATENT DOCUMENTS

| | | | |
|---|---|---|---|
| 3,543,768 | 12/1970 | Law | 131/175 |
| 3,918,464 | 11/1975 | Kolodziej | 131/175 |
| 4,774,970 | 10/1988 | Bell | 131/175 |
| 4,790,332 | 12/1988 | Wallace | 131/330 |
| 4,807,646 | 2/1989 | Sahar | 131/330 |
| 4,907,603 | 3/1990 | Chambers | 131/329 |

*Primary Examiner*—Vincent Millin
*Assistant Examiner*—Lynne A. Reichard
*Attorney, Agent, or Firm*—Terry M. Gernstein

[57] ABSTRACT

A smoking accessory includes a case that can completely contain a lighted cigarette. The cigarette foot end extends out of the case, and the smoker exhales smoke into a mouthpiece on the case that conducts the exhaled smoke into a filter chamber to be filtered before it is exhausted to the environment. The case includes an ash chamber next to a cigarette containing chamber, and a filter chamber is located adjacent to the cigarette containing chamber. A flexible hose having two passages can be connected to the case.

3 Claims, 3 Drawing Sheets

SMOKING ACCESSORY

TECHNICAL FIELD OF THE INVENTION

The present invention relates to the general art of tobacco smoking, and to the particular field of smoker's accessories.

BACKGROUND OF THE INVENTION

In spite of the many hazards that have been attributed to tobacco smoking, many people still enjoy smoking and choose to smoke. These people smoke both cigarettes and cigars. However, because of many reasons, many other people object to someone in the vicinity smoking. This dichotomy has led to many rules regulating when and where smokers are permitted to smoke. For example, many restaurants have smoking sections, or do not permit smoking at all, especially cigar smoking. The same is true of many other public facilities, such as airlines and the like. This has placed a substantial burden on the smoker.

Many smokers are quite sensitive to the feelings of non-smokers around them, and try to make every effort possible to smoke in a manner which will not disturb non-smokers in the vicinity. In spite of this effort, some non-smokers still are disturbed by the mere fact that someone is smoking.

Thus, several devices have been proposed to control smoke from either a cigarette or a cigar. Special ashtrays are an example of such devices.

However, devices, such as special ashtrays, are often cumbersome to carry about and to use, and are thus not amenable to use in airplanes or the like. More importantly, since such devices are intended to control the portion of the smoking process occurring between inhaling and exhaling, and do not control the smoke being exhaled by a smoker, such devices are not fully effective in trapping all the smoke associated with a smoking procedure. These devices are also not fully effective in controlling slip stream smoke, that is, the smoke emanating from a cigarette between a process of inhaling and exhaling.

Therefore, there is a need for a smoke controlling device which is fully effective in controlling all of the smoke associated with a smoking process, including smoke exhaled by the smoker as well as slip stream and exhaled smoke, and which is also fully portable to be amenable to use in airplanes, automobiles and other such situations.

OBJECTS OF THE INVENTION

It is a main object of the present invention to provide a smoke controlling device which is fully effective in controlling all of the smoke associated with a smoking process.

It is another object of the present invention to provide a smoke controlling device which is fully effective in controlling all of the smoke associated with a smoking process, including slip stream smoke and exhaled smoke.

It is another object of the present invention to provide a smoke controlling device which is fully effective in controlling all of the smoke associated with a smoking process, including side and exhaled smoke and which is also fully portable.

It is another object of the present invention to provide a smoke controlling device which is fully effective in controlling all of the smoke associated with a smoking process, including side exhaled smoke and which is also fully portable, yet will permit a smoker to leave the cigarette or cigar unattended for certain periods of time without that article going out.

SUMMARY OF THE INVENTION

These, and other, objects are achieved by a smoke controlling accessory that totally encases a lighted cigarette and includes a filtered path into which a smoker exhales. The device is about the size of a normal package of cigarettes and thus is fully portable, and can include an extension tube so that the device can be stored in a convenient location, even user's pocket, even with a lighted cigarette contained therein, while the smoker uses that device via the extension.

The device includes one-way valves so that air can reach a lighted cigarette and smoke from a cigarette is filtered so that a lighted cigarette will be kept burning for as long a two minutes between draws thereby permitting the smoker to leave the cigarette unattended.

BRIEF DESCRIPTION OF THE DRAWING FIGURES

DETAILED DESCRIPTION OF THE PREFERRED EMBODIMENT OF THE INVENTION

Figure 1:
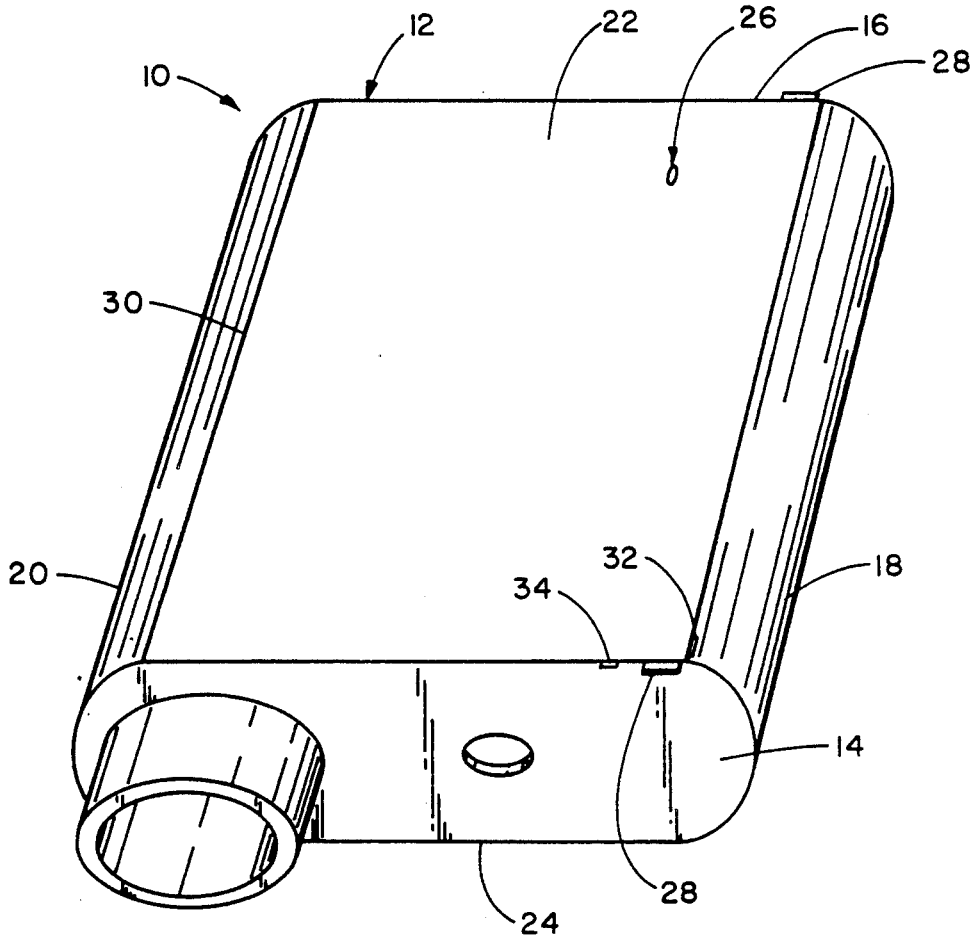
FIG. 1 is a perspective view of the smoking accessory of the present invention in the closed condition.
Figure 4:
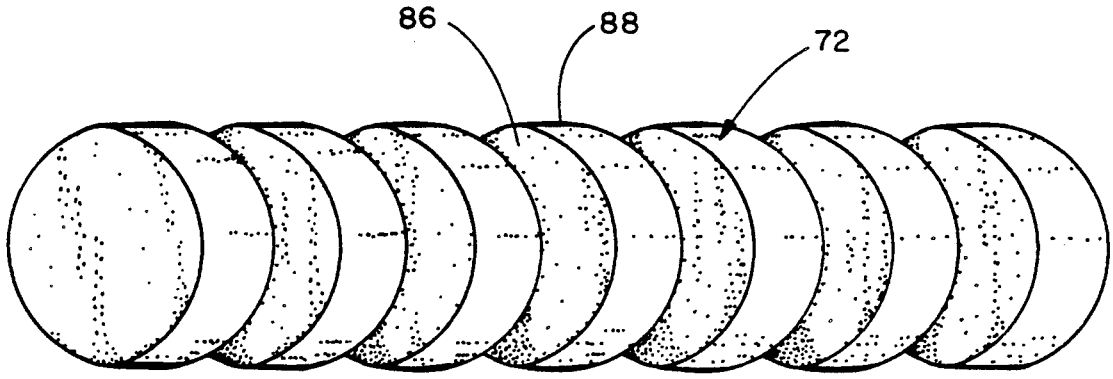
FIG. 4 is a perspective view of filters used in the smoking accessory of the present invention.

Shown in FIG. 1 is a smoking accessory 10 that can be used to totally encase a lighted smoking article, such as a cigarette or cigar, and contain the filter the smoke being exhaled from the article while also containing the smoke from the article itself.

The device includes a hollow case 12 that is formed of smoke-impermeable material, such as metal or the like, and which includes a front end wall 14, a rear end wall 16, first and second side walls 18 and 20 as well as a top 22 and a bottom 24.

Figure 2:
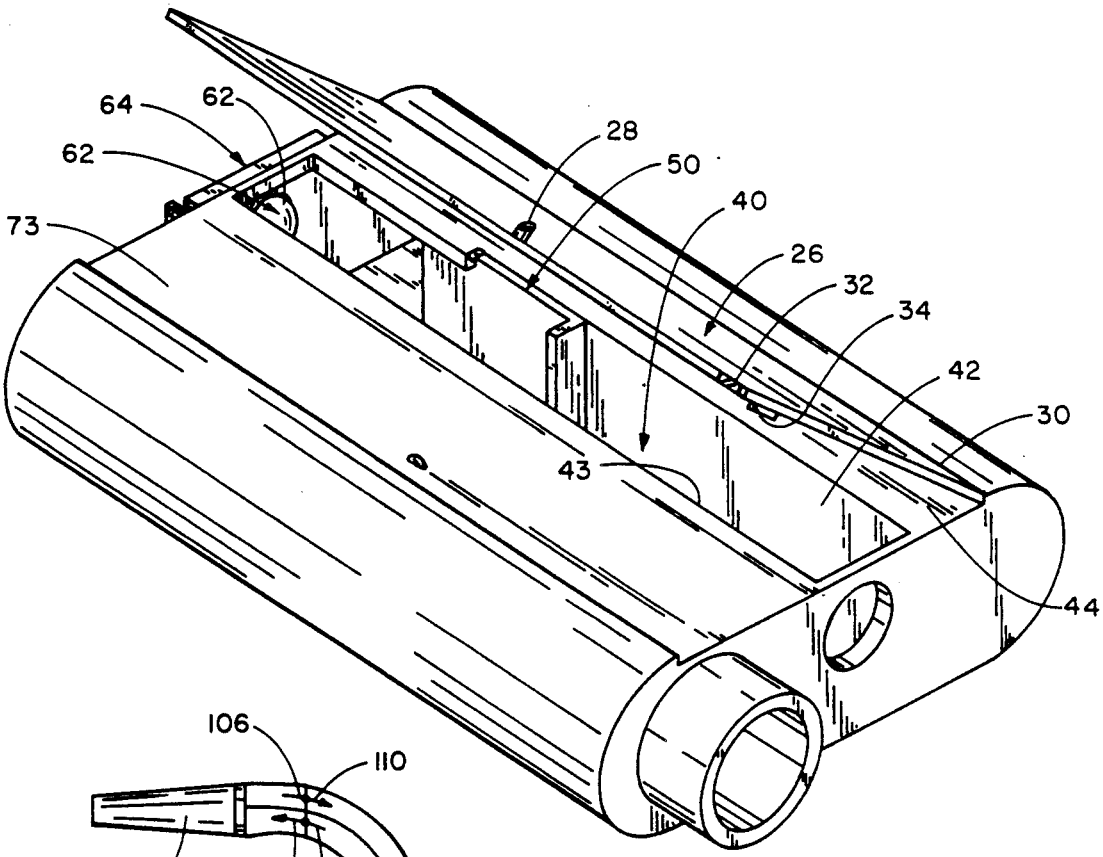
FIG. 2 is a perspective view of the smoking accessory in the open condition.
Figure 3:
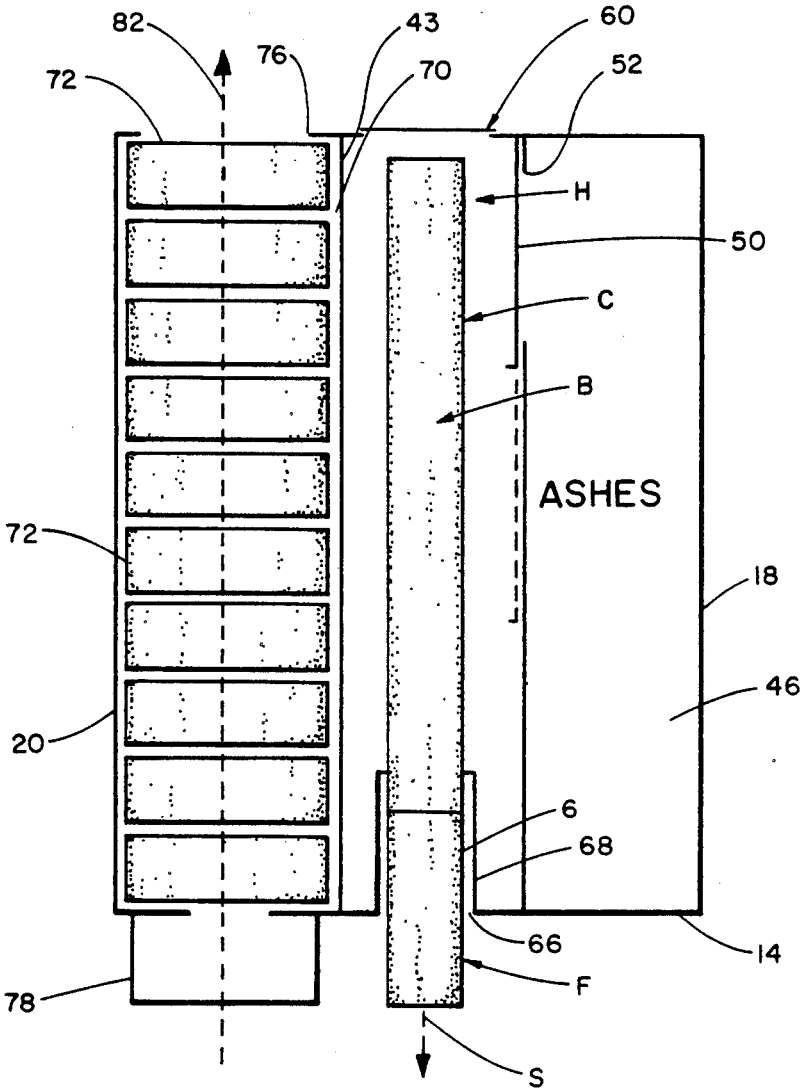
FIG. 3 is a top plan view of the smoking accessory in the open condition.
Figure 7:
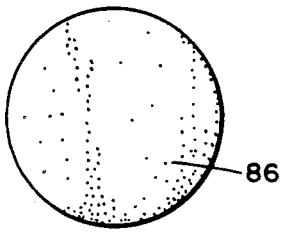
FIG. 7 is a top plan view of the filter.
Figure 6:
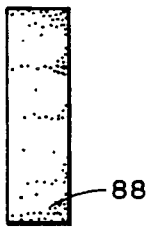
FIG. 6 is an end elevational view of the filter.
Figure 5:
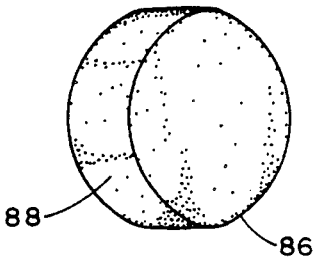
FIG. 5 is a perspective view of one of the filter elements used in the smoking accessory.

As indicated in FIGS. 2 and 3, the device 10 includes an access door 26 that is hingeably attached to the case to form a top when the device is closed. The door includes a handle 28 and a hinge 30 and is closed against the sides and ends in a smoke sealing manner. To this end, the device can include seals as indicated at seal portions 32 and 34, around the door. The seals will completely encircle the door.

The device is adapted to encase a lighted cigarette in a manner that prevents smoke emanating from that cigarette, either during use or during periods between use, from entering the environment around the cigarette. It is noted that, for the sake of convenience, the present disclosure will be directed to a cigarette, it is equally applicable to a cigar or other such smoking article.

The lighted cigarette is contained in a lighted cigarette containing compartment 40 that is defined within the hollow case by a first interior wall 42 that extends from the rear wall 16 to the front wall 14 and which is spaced from the side wall 18 and a second interior wall 43 that also extends from the rear wall 16 to the front wall 14. Both of the walls 42 and 43 are impervious to smoke. A top 44 extends from the top of the interior wall 42 to the side wall 18 to form a closed ash containing compartment 46. The top 44 is located to be immediately subadjacent to the device access door 26 from the rear wall 16 to the front wall 14 so that the ash containing compartment is closed.

A sliding door 50 is mounted on the wall 42 to slide from a closed condition shown in FIGS. 2 and 3 to a open condition, indicated in FIG. 3 by a phantom line to close and open an ash opening 52 defined through the wall 42. After a cigarette has been extinguished or exhausted, the ash and foot therefrom will be moved into the ash compartment by opening the door 50, tipping the device and shaking the ash into the compartment via the opening 52. The ash comparment can be emptied in a like manner by simply reversing the just-described process and dumping the ash from the ash compartment via the door 52 into a suitable receptacle.

The case has an ambient air intake valve, such as one-way valve 60, in the rear wall 16 that permits ambient air to enter the cigarette containing compartment 40 but prevents air from that compartment from passing back out of the case. A suitable one-way valve is a spring-loaded check valve having a ball 62 covering an opening in a manner that permits flow in one direction but checks and prevents flow in the other direction through the valve, such as disclosed in standard fluid mechanics textbooks, such as "Fluid Power and Control Systems" by E.C. Fitch, Jr, and published by Mcgraw-Hill in 1966, or in standard handbooks, such as "Marks' Standard Handbook for Mechanical Engineers", Seventh edition edited by T. Baumeister and published by McGraw-Hill in 1967, the disclosures of which are incorporated herein by reference.

A door 64 can cover the valve 60 so that the cigarette can be extinguished by simply cutting off all source of oxygen to the interior of the cigarette containing compartment. The door 64 is mounted on the rear end of the case to move from a valve uncovering position indicated in FIG. 3 by phantom lines to a valve covering position indicated in FIG. 3 by full lines.

A cigarette access opening 66 is defined through the case front wall 14. The cigarette C shown in FIG. 3 has a head end H which is lit, a body B and a foot end F through which smoke is drawn for smoking. A filter G can be included on the foot end of the cigarette. As can be seen in FIG. 3, the cigarette head end is located adjacent to the air intake valve and the foot end extends through the access opening 66 to be available to the smoker. A support tube 68 is mounted on the case inner surface adjacent to the access opening to support the cigarette in the desired position so that smoke can be drawn out of the cigarette as indicated by arrow S.

The second interior wall 43 is spaced from the case side 20 to define a filter compartment 70 which contains a plurality of cylindrical filter blocks, such as block 72. The filter compartment includes a handled top 73 that is hinged to the wall 43 to be opened and closed and when closed will be immediately subadjacent to the top 26. In this manner, filter blocks can be inserted and removed as necessary to change and clean such filter media. However, the filter compartment will be sealed when the top 26 is shut so that smoke from a cigarette contained in the device will not have access to the environment via the filter compartment without passing through the filter media as will be seen from the discussion presented below.

The wall 43 can include an opening 74 that permits smoke from the cigarette containing compartment to pass directly into the filter compartment without being inhaled by the smoker. This will provide an escape route for the smoke from a cigarette in the compartment 40 in the event that cigarette is left for a lengthy period of time without being smoked. The smoke from the cigarette will be forced to pass through the filter media before it exits the case, and thus will not be dangerous or undesirable.

The case includes an exit opening 76 defined in the case rear wall 16 to place the interior of the filter compartment into communication with the environment surrounding the case. The filter blocks are located to cover this exit opening so that only filtered air will exit the opening 76.

The case also includes a mouthpiece 78 mounted on the front wall 14. The mouthpiece is a hollow tube and is fluidically connected to the filter compartment via a one-way valve 80 which can be mounted on the wall 14 to permit air to move into the filter compartment in the direction or arrow 82, but to prevent air from passing in the opposite direction. In this manner, air will be forced to pass through the filter media before it can exit the case via the hole 76, and thus will be filtered.

The smoker exhales the smoke into the mouthpiece and this exhaled smoke will be filtered before it is permitted to enter the environment.

Suitable filter media blocks include charcoal and the like, or pressed material having suitable porosity or the like. Those familiar with filtration of gas will understand what type of materials will be necessary from their own knowledge and from standard handbooks, such as the above-incorporated "Standard Handbook for Mechanical Engineers". The blocks are best shown in FIGS. 4, 5, 6 and 7 as including porous media 86 supported in a cylindrical case 88. The case 88 is impervious to smoke, and thus the smoke is forced to flow through the filtering material.

In use, the smoker lights a cigarette, places that cigarette into the cigarette containing chamber and closes the top 26 of the case. The smoker then can inhale from the cigarette via the foot thereof that extends out of the case via the hole 66 and then can exhale back into the case via the mouthpiece. Smoke from the cigarette is filtered by passing through hole 74 and by passing through the valve 80 and the opening 76.

Once the cigarette is finished, the ash and the butt therefrom can be moved from the chamber 40 into the ash chamber 46 by opening the door 50 and shaking these remains into that chamber. The chamber 46 can be emptied as necessary. The filter media can be changed as necessary by simply opening the door 73 and removing the blocks and replacing them as required.

Figure 8:
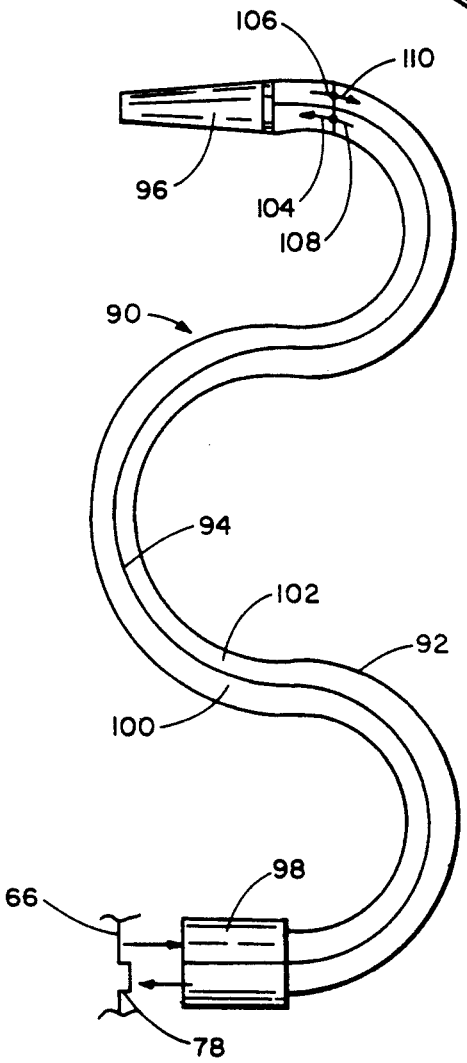
FIG. 8 is a top plan view of a flexible hose that is used to permit the smoker to store a lighted cigarette or cigar in a totally encased manner in one location, yet use the device from another location.

In some instances, it may be desirable to use the device 10 in an entirely hands-free manner. This will require the case to be supported in some location, such as in the smoker's pocket, and the smoke from the cigarette inhaled from the case and exhaled back into the case from a location spaced from the case. This is accomplished by attaching a flexible hose 90 to the case. The hose 90 is shown in FIG. 8. This hose includes an outer casing 92 that is impermeable to smoke and a divider wall 94 extending the entire length thereof. The divider wall is also impervious to smoke. A mouthpiece 96 is attached to one end of the hose and a connection coupling 98 is attached to the other end of the hose. The divider wall 94 divides the hose interior into an inhalation passage 100 and an exhalation passage 102. Smoke from the cigarette to be inhaled by the smoker passes through the inhalation passage 100, and smoke exhaled by the smoker passes through the exhalation passage 102.

Flow through the inhalation and exhalation passages is controlled by one-way valves 104 and 106 respectively. The valves are mounted near the mouthpiece and control the flow in the manner of a usual one-way check valve to flow in direction 108 in the inhalation passage and in direction 110 in the exhalation passage.

The coupling 98 is sized to cover the opening 66 and receive the foot end of the cigarette and to also cover the mouthpiece 78, with the inhalation passage being fluidically connected to the opening 66 and the exhalation passage being fluidically connected to the mouthpiece 78. The relative positions of these elements is indicated in FIG. 8, with the divider wall 94 separating the portion of the coupling associated with the opening 66 from the portion of the coupling associated with the mouthpiece 78.

The smoker uses the hose by simply connecting it to the case so that the coupling 98 covers the opening 66 and the mouthpiece 78 and then operates the case as above described. The smoke is inhaled and exhaled via the mouthpiece 96. The case otherwise operates as above described.

It is understood that while certain forms of the present invention have been illustrated and described herein, it is not to be limited to the specific forms or arrangements of parts described and shown.

I claim:

1. A smoking accessory comprising:

(A) a smoke-impermeable hollow case having a front end wall and a rear end wall, a top and a bottom, and first and second side walls;

(B) an access door hingeably connected to said case top for providing access to the interior of said hollow case when said door is open;

(C) a lighted cigarette containing compartment in said case and which includes (1) a first interior wall extending inside said case from said case rear end wall to said case front end wall, said first interior wall being spaced from said first side wall, (2) a second interior wall extending inside said case from said case rear end wall to said case front end wall and being spaced from said first interior wall and from said case second side wall, (3) an ash opening defined through said first interior wall, (4) a sliding door portion on said first interior wall which slides from a closed position covering said ash opening to an open position uncovering said ash opening, (5) a one-way valve in said case rear end wall for conducting ambient air into said lighted cigarette containing compartment but preventing air from passing out of said cigarette compartment via said one-way valve, (6) a cigarette access opening defined through said case front end wall through which a cigarette foot end extends for access to a smoker, and (7) a cigarette support tube mounted on said case front wall adjacent to said cigarette access opening;

(D) an ash compartment defined between said first interior wall and said case first side wall, said ash compartment including a top wall located to be adjacent to said case access door when said case access door is closed, said ash compartment extending from said case front end wall to said case rear end wall and being opened and closed by said sliding door;

(E) a filter compartment defined between said second interior wall and said case second side wall and extending from said case front end wall to said case rear end wall, said filter compartment including (1) a top wall hingeably connected to said second interior wall to be adjacent to said case access door when said access door is closed, (2) an exit opening defined in said case rear end wall to permit filtered gas in said filter compartment to escape from said case, (3) a mouthpiece mounted on said case front end wall and a one-way valve mounted on said front end wall in covering relation to said mouthpiece for conducting air into said filter compartment via said mouthpiece but preventing air from passing out of said filter compartment via said mouthpiece, (4) a passage in said second interior wall for conducting smoke from said cigarette containing compartment into said filter compartment, and (5) a one-way valve mounted on said second interior wall in covering relation to the passage in said second interior wall to permit smoke to flow into said filter compartment from said cigarette containing compartment but to prevent smoke from passing from said filter compartment to said cigarette containing compartment via said passage; and (F) filter media located in said filter compartment.

2. The smoking accessory defined in claim 1 wherein said filter media includes a plurality of cylindrical filter blocks.

3. The smoking accessory defined in claim 2 further including a flexible hose having (1) an outer casing that is impermeable to cigarette smoke, (2) a case engaging end and a smoking end, (3) a mouthpiece on said smoking end, (4) a cigarette smoke impervious dividing wall extending from said case engaging end to said smoking end and dividing said hose into a smoke inhalation passage and a smoke exhalation passage, (5) a one-way valve mounted in said inhalation passage which permits smoke to flow only from said case engaging end to said smoking end, (6) a one-way valve in said exhalation passage which permits smoke to flow only from said smoking end to said case engaging end, (7) coupling mounted on said case engaging end which includes (a) a cigarette foot receiving cover connected to said inhalation passage to conduct smoke from said cigarette foot to said hose mouthpiece, and (b) a case mouthpiece receiving portion connected to said exhalation passage to conduct smoke exhaled by a smoker to said filter chamber.

* * * * *